US007143842B2

(12) United States Patent
Ikuta

(10) Patent No.: US 7,143,842 B2
(45) Date of Patent: Dec. 5, 2006

(54) POWER TOOL

(75) Inventor: Hiroki Ikuta, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 11/201,085

(22) Filed: Aug. 11, 2005

(65) Prior Publication Data

US 2006/0048958 A1 Mar. 9, 2006

(30) Foreign Application Priority Data

Aug. 17, 2004 (JP) ..... 2004-237255

(51) Int. Cl.
*B25D 11/00* (2006.01)

(52) U.S. Cl. ..... 173/201; 173/109; 173/216

(58) Field of Classification Search ..... 173/109, 173/201, 122, 216, 178, 114, 176, 48
See application file for complete search history.

(56) References Cited

U.S. PATENT DOCUMENTS

| | | | | |
|---|---|---|---|---|
| 4,895,212 | A * | 1/1990 | Wache | 173/48 |
| 5,873,418 | A * | 2/1999 | Arakawa et al. | 173/212 |
| 6,520,266 | B1 * | 2/2003 | Bongers-Ambrosius et al. | 173/2 |
| 6,557,648 | B1 * | 5/2003 | Ichijyou et al. | 173/48 |
| 6,725,944 | B1 * | 4/2004 | Burger et al. | 173/48 |
| 6,739,405 | B1 * | 5/2004 | Plietsch | 173/201 |
| 6,971,455 | B1 * | 12/2005 | Shibata et al. | 173/48 |
| 6,988,563 | B1 * | 1/2006 | Hashimoto et al. | 173/48 |
| 2002/0056558 | A1 | 5/2002 | Bongers-Ambrosius et al. | |
| 2002/0170186 | A1 | 11/2002 | Sakaguchi | |

FOREIGN PATENT DOCUMENTS

| | | |
|---|---|---|
| DE | 39 22 357 A1 | 1/1991 |
| DE | 40 38 586 A1 | 6/1992 |
| EP | 0 063 725 A2 | 11/1982 |
| EP | 1 304 197 A2 | 4/2003 |
| JP | B2 4-31801 | 5/1992 |
| JP | A 2004-216484 | 8/2004 |

* cited by examiner

*Primary Examiner*—Scott A. Smith
(74) *Attorney, Agent, or Firm*—Oliff & Berridge, PLC

(57) ABSTRACT

It is an object of the invention to provide a reciprocating power tool having a further improved power transmitting mechanism for converting a rotating output of a driving motor into linear motion in the axial direction of the tool bit. The representative reciprocating power tool may comprise a tool bit, a driving motor and a power transmitting mechanism that converts a rotating output of the driving motor into linear motion in the axial direction of the tool bit. The power transmitting mechanism includes an internal gear, a planerary gear, a power transmitting part, a rotation preventing mechanism and an internal gear rotation lock. Further, an internal gear rotation lock prevents the internal gear from rotating in a direction opposite to said predetermined direction. Therefore, the internal gear rotated only in one direction via the internal gear rotation lock and as a result, the internal gear can be reliably locked in a predetermined position without causing rattling. Thus, the accuracy of the locked position of the internal gear can be enhanced and stable operation can be realized.

11 Claims, 6 Drawing Sheets

POWER TOOL

BACKGROUND OF THE INVENTION

1. Field of the Invention

Japanese patent application filed on Aug. 17, 2004 before the Japanese Patent Office with filing serial NO. 2004-237255 is entirely incorporated by reference. The present invention relates to a technique for constructing a reciprocating power tool having a power transmitting mechanism that converts rotating output of a driving motor to linear motion in the axial direction of a tool bit.

2. Description of the Related Art

Japanese Patent Publication No. 4-31801 discloses an electric hammer with a starting clutch. According to the known hammer, clutch engagement can be controlled by means of a striker and a pusher. The striker and the pusher can slide axially within a spindle that holds a hammer bit. With this construction, while the motor is driven, striking element does not perform a reciprocating motion as long as the hammer bit is not pressed against the workpiece.

In addition to such improvement in the starting characteristics of the driving mechanism, a further improvement is highly desired with respect to the driving mechanism which operates in relation to the load applied to the hammer bit.

SUMMARY OF THE INVENTION

Accordingly, it is an object of the present invention to provide a reciprocating power tool having a further improved power transmitting mechanism for converting a rotating output of a driving motor into linear motion in the axial direction of the tool bit.

Said object is solved by a reciprocating power tool having features of Claim 1. The representative reciprocating power tool may comprise a tool bit, a driving motor and a power transmitting mechanism that converts a rotating output of the driving motor into linear motion in the axial direction of the tool bit. The power transmitting mechanism includes an internal gear, a planerary gear, a power transmitting part, a rotation preventing mechanism and an internal gear rotation lock. The internal gear is rotatably supported to receive the rotating output of the driving motor all the time. The planetary gear is driven by the rotating output of the driving motor to revolve around the center of the internal gear The power transmitting part is eccentrically disposed on the planetary gear. The rotation preventing mechanism normally prevents rotation of the internal gear. The rotation preventing mechanism is adapted to stop preventing rotation of the internal gear in relation to a load applied to the tool bit and to allow the internal gear to rotate by a predetermined degree and in a predetermined direction. Thus, the relative position of the power transmitting part is changed with respect to a point of proximity of the planetary gear to the internal gear. As a result, a linear stroke of the power transmitting part in the axial direction of the tool bit is changed.

The representative reciprocating power tool further includes an internal gear rotation lock that prevents the internal gear from rotating in a direction opposite to said predetermined direction. Therefore, the internal gear rotated only in one direction via the internal gear rotation lock and as a result, the internal gear can be reliably locked in a predetermined position without causing rattling. Thus, the accuracy of the locked position of the internal gear can be enhanced and stable operation can be realized.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved power tools and method for using such power tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
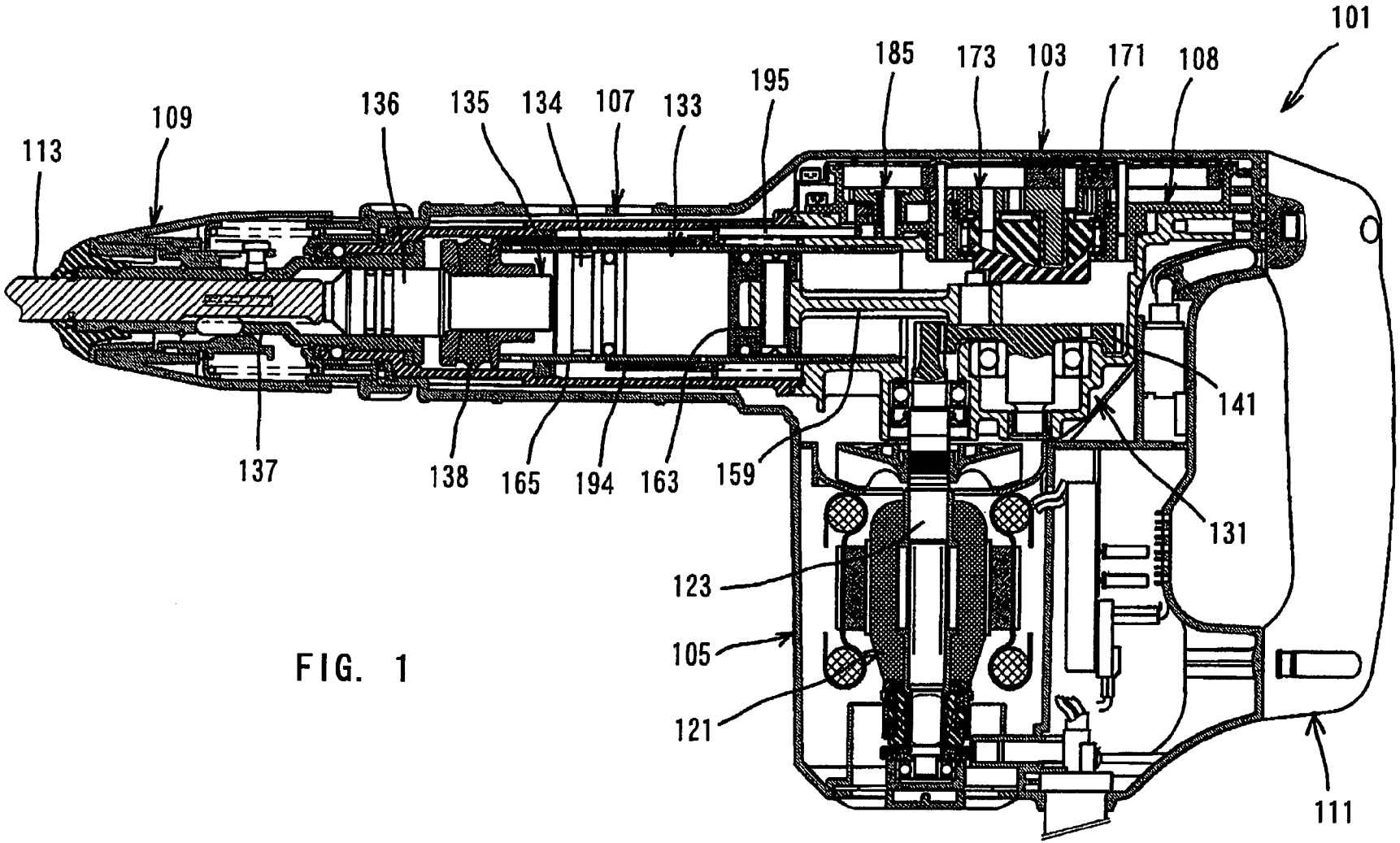
FIG. 1 is a sectional view schematically showing an entire hammer according to a representative embodiment of the invention.

A hammer according to a representative embodiment of the present invention will now be described with reference to the drawings. FIG. 1 shows an entire hammer 101. The representative hammer 101 is an example of the "reciprocating power tool" according to the present invention. The hammer 101 includes a body 103 having a motor housing 105, a gear housing 107 and a handgrip 111. A hammer bit 113 is connected to the tip end (the left end region as viewed in FIG. 1) of the body 103 of the hammer 101 via a hammer bit mounting chuck 109. The hammer bit 113 is a feature that corresponds to the "tool bit" according to the present invention.

The motor housing 105 houses a driving motor 121. The gear housing 107 houses a crank mechanism 131, an air cylinder mechanism 133 and a striking force transmitting mechanism 135. A tool holder 137 for holding the hammer bit 113 is disposed on the end (left end as viewed in FIG. 1) of the striking force transmitting mechanism 135 within the gear housing 107. The crank mechanism 131 in the gear housing 107 converts the rotating motion of an output shaft 123 of the driving motor 121 and transmits the motion to the hammer bit 113. As a result, the hammer bit 113 is caused to perform a hammering operation. The tool holder 137 holds the hammer bit 113 in such a manner that the hammer bit 113 reciprocates with respect to the tool holder 137 in its longitudinal direction and is prevented from rotating in its circumferential direction with respect to the tool holder 137.

Figure 2:
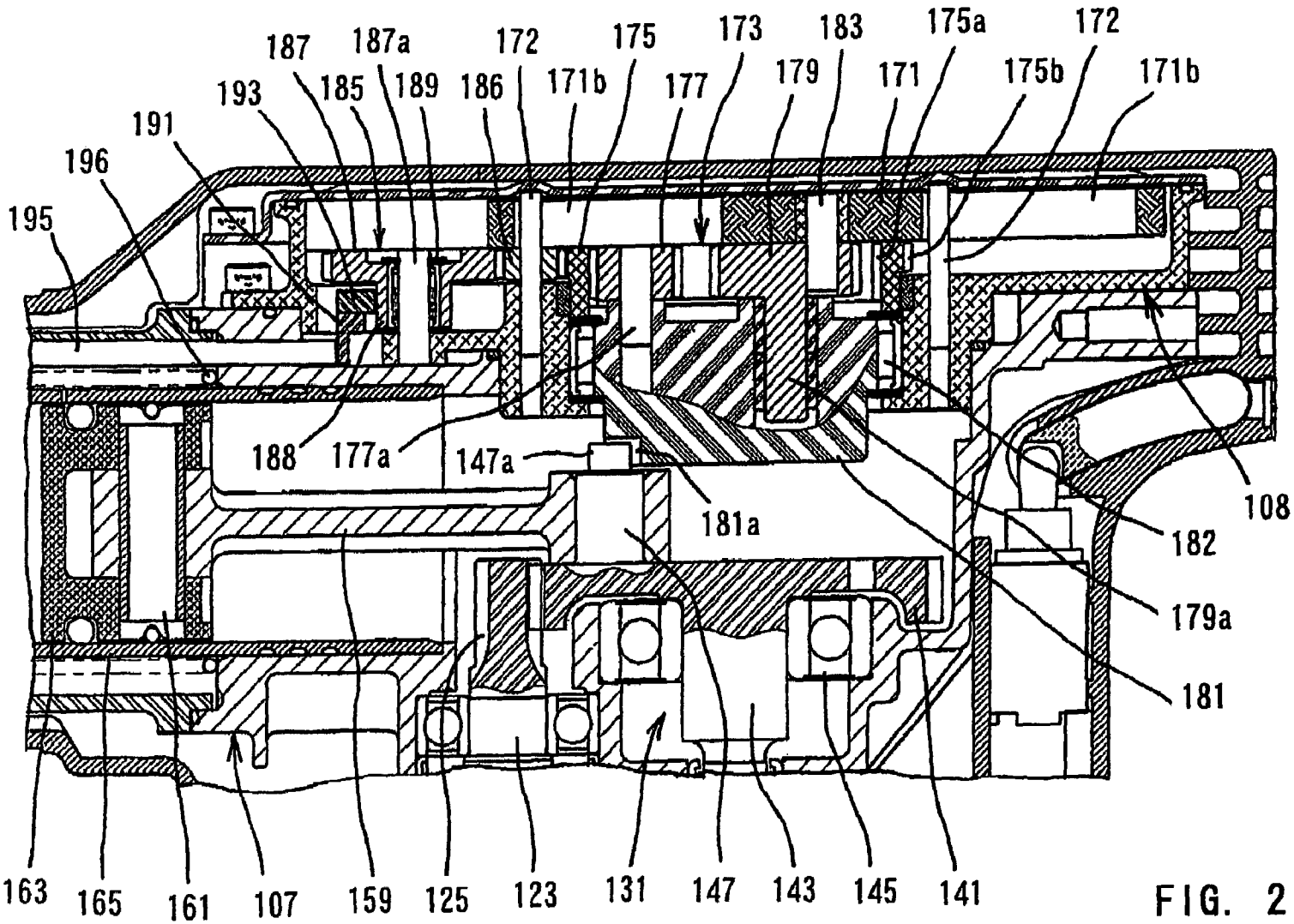
FIG. 2 is a sectional view of an essential part of the representative hammer.

FIG. 2 shows an essential part of the hammer 101 including the crank mechanism 131. The crank mechanism 131 in the gear housing 107 is disposed right below a housing cap 108 within the gear housing 107 and includes a speed change gear 141, a gear shaft 143, a gear shaft support bearing 145 and a crank pin 147. The speed change gear 141 engages with a gear part 125 of the output shaft 123 of the driving motor 121. The gear shaft 143 rotates together with the speed change gear 141. The gear shaft support bearing 145 rotatably supports the gear shaft 143. The crank pin 147 is integrally formed with the speed change gear 141 in a position displaced a predetermined distance from the center of rotation of the gear shaft 143. The crank pin 147 is connected to one end of a crank arm 159. The other end of the crank arm 159 is connected to a driver 163 via a connecting pin 161. The driver 163*s* is disposed within a bore of a cylinder 165 that forms the air cylinder mechanism 133 (see FIG. 1). The driver 163 slides within the cylinder 165 to linearly drive the striker 134 (see FIG. 1) by utilizing so-called air spring function. As a result, the driver 163 generates impact loads upon the hammer bit 113 via an intermediate element in the form of an impact bolt 136.

Figure 3:
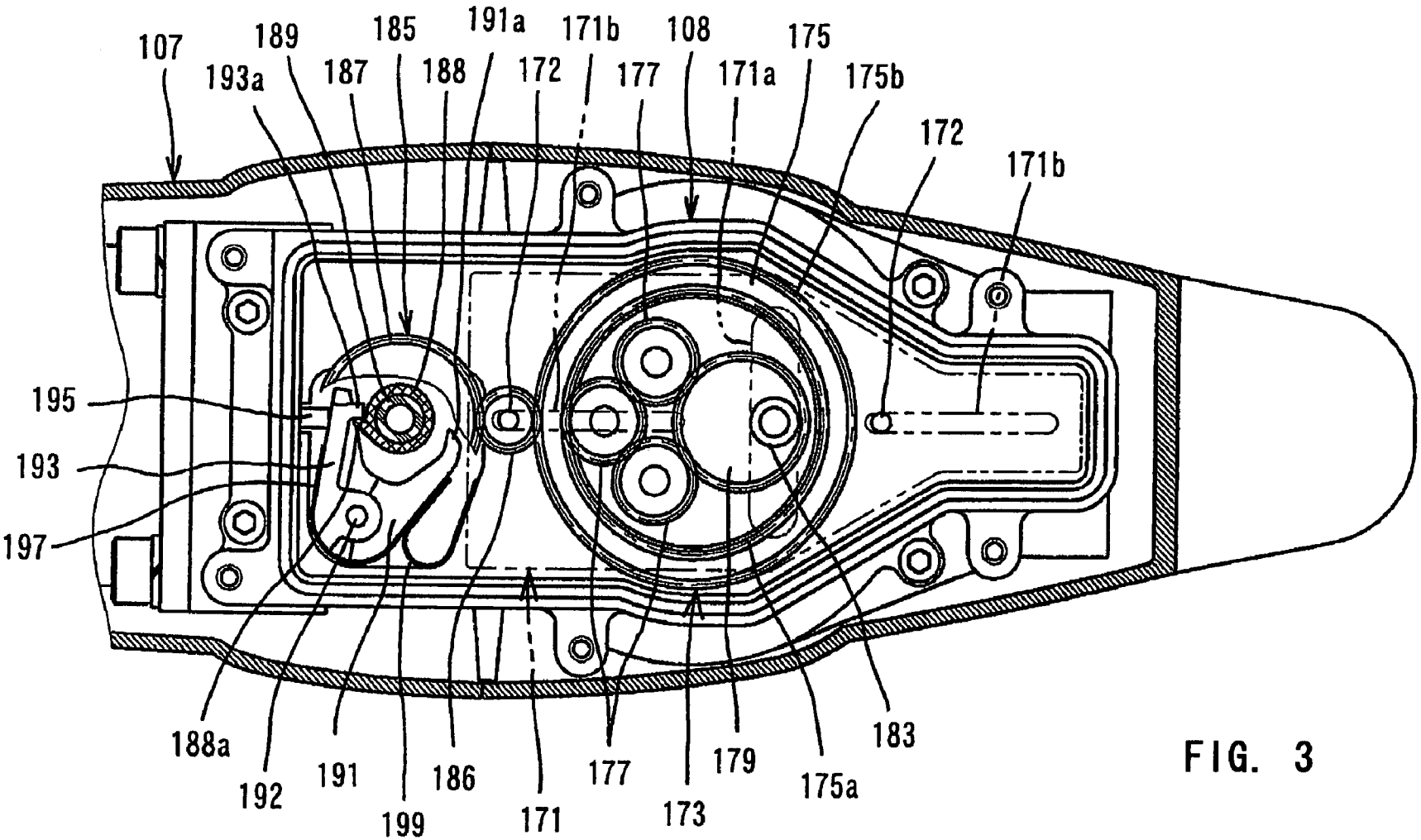
FIG. 3 is a plan view showing a counter weight driving mechanism and a rotation preventing mechanism under loaded driving conditions.
Figure 4:
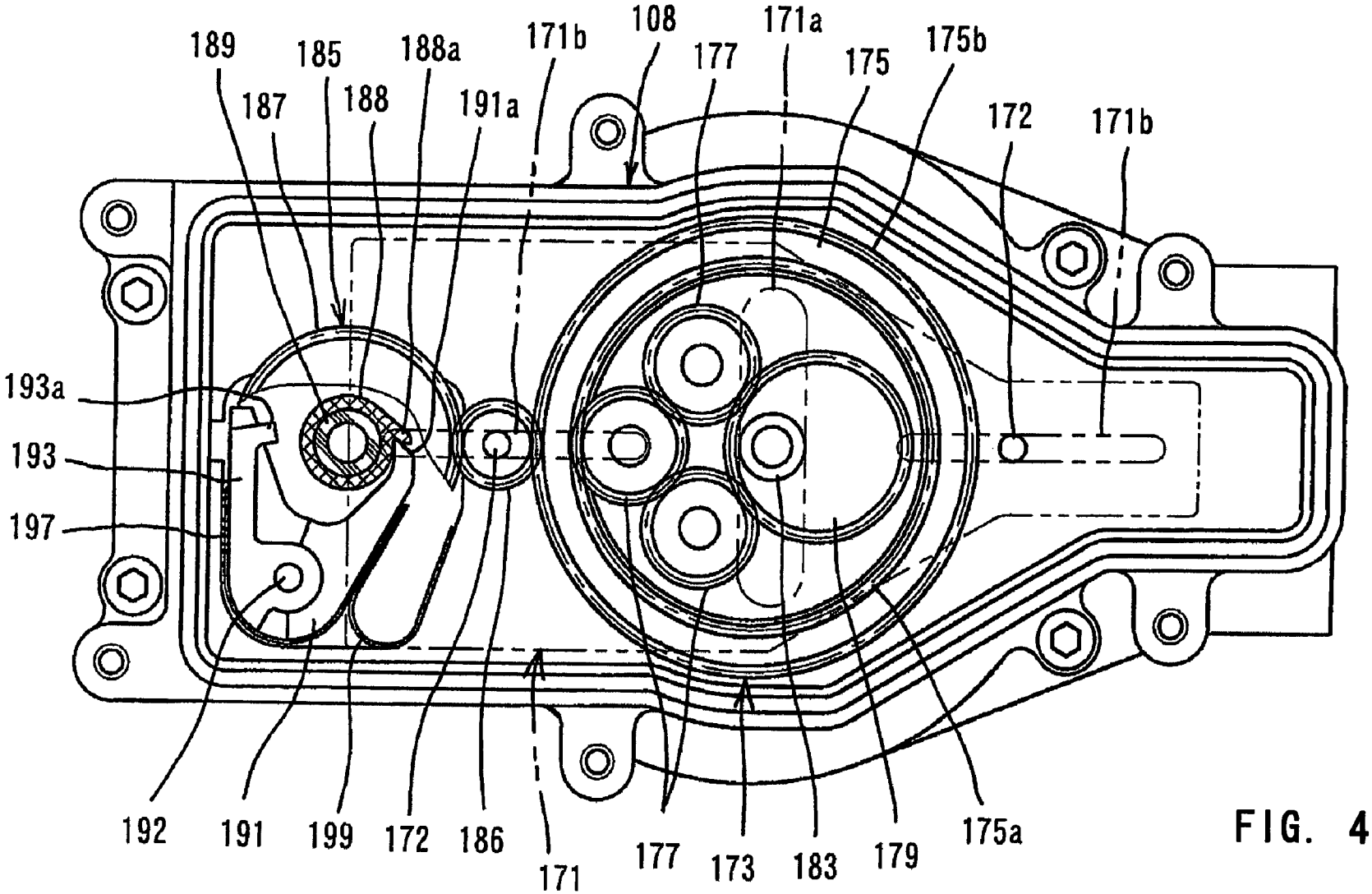
FIG. 4 is a plan view showing the counter weight driving mechanism and the rotation preventing mechanism under unloaded driving conditions.

A counter weight driving mechanism 173 is shown in FIGS. 2 to 4. The counter weight driving mechanism 173 drives a counter weight 171 that serves to reduce vibration when the hammer bit 113 is driven. The counter weight 171 is disposed above the housing cap 108 and can be moved linearly in the axial direction of the hammer bit 113. The counter weight 171 has a guide slot 171*b* extending in the axial direction of the hammer bit 113. A plurality of (two in this embodiment) guide pins 172 extend through the guide slot 171*b* and guide the counter weight 171 to move linearly in the axial direction of the hammer bit 113. The guide pins 172 are fixedly mounted to the housing cap 108.

The counter weight driving mechanism 173 is disposed between the crank mechanism 131 and the counter weight 171 and serves to cause the counter weight 171 to reciprocate in a direction opposite to the reciprocating direction of the striker 134. The counter weight driving mechanism 173 includes an internal gear 175, a planetary gear 179, a carrier 181 and a counter weight driving pin 183. The planetary gear 179 engages with inner teeth 175*a* of the internal gear 175 via a plurality of (three in this embodiment) idle gears 177. The carrier 181 rotatably supports the planetary gear 179 and the idle gears 177. The counter weight driving pin 183 is integrally formed with the planetary gear 179 in a position displaced a predetermined distance from the center of rotation of the planetary gear 179 with respect to the carrier 181. The counter weight driving pin 183 is a feature that corresponds to the "power transmitting part" according to the invention.

The carrier 181 is rotatably supported by the housing cap 108 via a carrier support bearing 182. An engagement recess 181*a* is formed in the underside of the carrier 181 and engages with a top pin part 147*a* of the crank pin 147 of the crank mechanism 131. Thus, when the crank pin 147 rotates, the carrier 181 is caused to rotate around an axis parallel to the axis of rotation of the speed change gear 141. The planetary gear 179 has a shaft 179*a* that is rotatably supported by the carrier 181. Each of the idle gears also has a shaft 177*a* rotatably supported by the carrier 181. The internal gear 175 is rotatably supported by the carrier 181 and directly or indirectly contacts the upper surface of the carrier 181. A rotating force of the carrier 181 is applied to the internal gear 175 via a frictional force of the contact portion between the carrier 181 and the internal gear 175 or via grease filled into the gear housing 107. In addition to the rotating force of the carrier 181, the internal gear 175 receives a rotating force caused when the planetary gear 179 revolves (around the center of the internal gear 175) by friction between the planetary gear 179 and the carrier 181, or a rotating force caused by the reaction force from the counter weight 171 to be driven by the counter weight driving pin 183. Rotation of the internal gear 175 is normally prevented or allowed by a rotation preventing mechanism 185. The counter weight driving mechanism 173 and the rotation preventing mechanism 185 are features that correspond to the "power transmitting mechanism" according to the invention.

The counter weight driving pin 183 is slidably fitted in a slot 171*a* formed in the counter weight 171 and extends linearly in a direction perpendicular to the axial direction of the hammer bit 113. When the carrier 181 is rotated by the crank pin 147 in the state in which the rotation of the internal gear 175 is prevented, the planetary gear 179 that engages with the internal gear 175 via the idle gears 177 revolves around the center of rotation of the internal gear 175 while rotating around the shaft 179*a*. At this time, the counter weight 117 is caused to reciprocate by components of motion of the counter weight driving pin 183 in the axial direction of the hammer bit 113. Thus, the counter weight 171 reciprocates in a direction substantially opposite to the reciprocating direction of the striker 134 that is driven by the crank mechanism 131 via the air cylinder mechanism 133.

Figure 5:
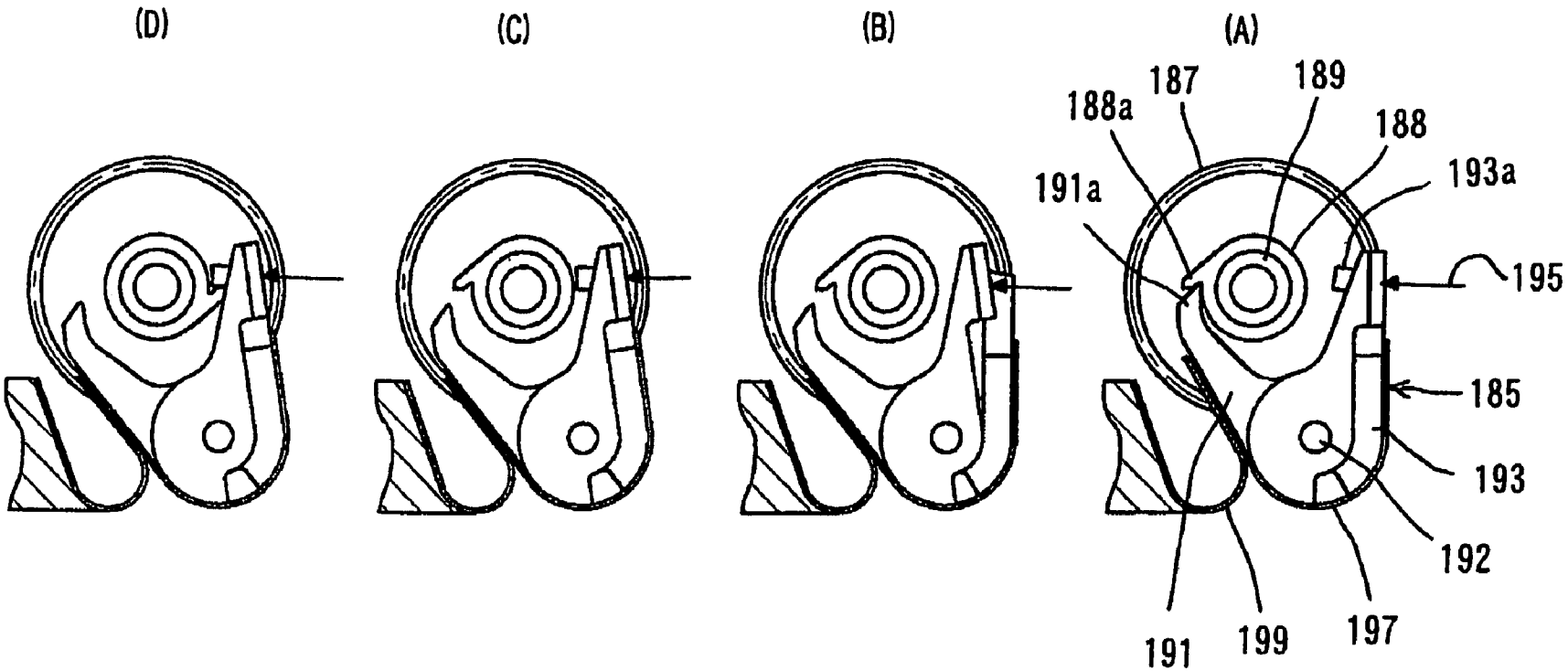
FIG. 5 is a backside view of FIGS. 3 and 4 and showing the operation of the rotation preventing mechanism.

The rotation preventing mechanism 185 for preventing rotation of the internal gear 175 will now be explained with reference to FIGS. 2 to 5. FIG. 5 shows the operation of the rotation preventing mechanism 185 shown in FIGS. 3 and 4 and viewed from the backside. The rotation preventing mechanism 185 changes the rotation prevented position of the internal gear 175 so that the stroke of the counter weight driving pin 183 in the axial direction of the hammer bit 113 and thus the linear stroke of the counter weight 171 in the axial direction of the hammer bit 113 can be changed. Thus, the rotation preventing mechanism 185 forms a stroke control mechanism of the counter weight 171. The internal gear 175 has external teeth 175b on its outer peripheral surface. The rotation preventing mechanism 185 includes a gear with cam 187, a one-way clutch 189, a first and a second stoppers 191, 193 (see FIGS. 3 and 4), a switching rod 195 and a first and a second leaf springs 197, 199 (see FIGS. 3 and 4). The one-way clutch 189 allows the gear 187 to rotate only in one direction. The first and second stoppers 191, 193 prevent rotation of the gear 187. The switching rod 195 operates to cause the first and second stoppers 191, 193 to switch between the rotation prevented position and the rotation allowed position when the hammer bit 113 moves in its axial direction (slides into and out of the tool holder 137). The first and second leaf springs 197, 199 are associated with each other so as to cause the first and second stoppers 191, 193 to move to the rotation prevented position or the rotation allowed position.

The gear with cam 187 is mounted onto a gear shaft 187*a* via the one-way clutch 189 such that the gear 187 can rotate only in one direction. The gear shaft 187*a* is fixedly mounted to the housing cap 108. The gear 187 further engages with the external teeth 175*b* of the internal gear 175 via the idle gear 186. A cam 188 of the gear 187 is a cylindrical part integrally formed with the gear 187 and has an engagement part 188*a* on its outer peripheral surface. As shown in FIGS. 3 and 4, the first and second stoppers 191, 193 are disposed oppositely to each other with respect to the cam 188 of the gear 187. One end of each of the first and second stoppers 191, 193 is rotatably supported on the housing cap 108 via a common support shaft 192. The first and second stoppers 191, 193 have respective claws 191*a*, 193*a* on the other distal end. The claws 191*a*, 193*a* can engage with the engagement part 188*a* of the cam 188. Rotation of the gear 187 is prevented when the claw 191*a* of the first stopper 191 or the claw 193*a* of the second stopper 193 engages with the engagement part 188*a* of the cam 188. As a result, rotation of the internal gear 175 is prevented. The positions in which the claws 191*a*, 193*a* of the first and second stoppers 191, 193 can engage with the engagement part 188*a* of the cam 188 correspond to the above-mentioned rotation prevented position, while the positions in which the claws 191*a*, 193*a* disengage from the engagement part 188*a* correspond to the above-mentioned rotation allowed position.

The switching rod 195 is disposed parallel to the longitudinal direction of the cylinder 165 on the outside of the cylinder 165. One end of the switching rod 195 abuts on a slide sleeve 194 (see FIG. 1) that is disposed around the cylinder 165, while the other end abuts on the first stopper 191. The switching rod 195 is slidably disposed within the gear housing 107. The slide sleeve 194 is biased toward the hammer bit 113 by a slide sleeve biasing spring 196 and is held in a position in which the slide sleeve 194 contacts the tool holder 137 via a cushion 138 (see FIG. 1). When the slide sleeve 194 moves rightward (as viewed in FIG. 1) against the biasing force of the slide sleeve biasing spring 196, the switching rod 195 presses on the first stopper 191 from the backside and rotationally displaces the first stopper 191 in a direction that causes the claw 191*a* of the first stopper 191 to disengage from the engagement part 188*a* of the cam 188. At this time, the second stopper 193 is rotationally displaced by a biasing force of the first leaf spring 197 in a direction that causes the claw 193*a* of the second stopper 193 to engage with the engagement part 188*a* of the cam 188. When the switching rod 195 presses on the first stopper 191 and rotationally displaces the first stopper 191, the second leaf spring 199 is pressed by the first stopper 191 and thus elastically deforms. Therefore, when the switching rod 195 stops pressing on the first stopper 191, the second leaf spring 199 moves the first stopper 191 by its restoring force in a direction that causes the claw 191*a* of the first stopper 191 to engage with the engagement part 188*a* of the cam 188. At this time, the first stopper 191 rotationally displaces the second stopper 193 in a direction that causes the claw 193*a* of the second stopper 193 to disengage from the engagement part 188*a* of the cam 188. Specifically, the first and second leaf springs 197, 199 are associated with each other so as to cause the first and second stoppers 191, 193 to rotationally displace in the same direction.

Figure 6:
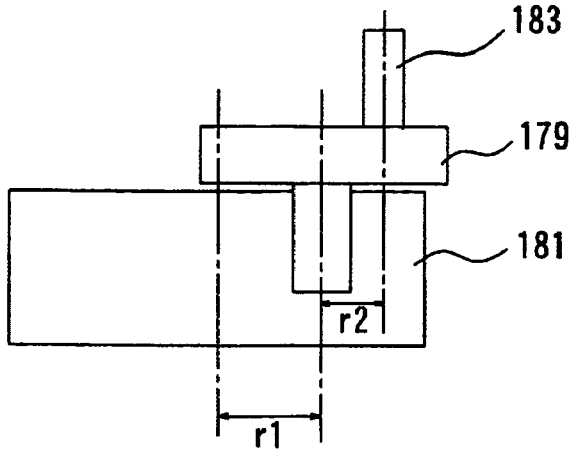
FIG. 6 is a schematic view showing the setting conditions of the counter weight driving mechanism.

The representative hammer 101 is constructed as described above. Specifically, in the hammer 101, the stroke of the counter weight driving pin 183 in the axial direction of the hammer bit 113 can be changed by changing the rotation prevented position of the internal gear 175, so that the linear stroke of the counter weight 171, which is driven by the counter weight driving pin 183, in the axial direction of the hammer bit 113 can be changed. The principle will now be explained. The number of the teeth of the planetary gear 179 is chosen to be half of the number of the internal teeth 175*a* of the internal gear 175. In other words, the planetary gear 179 turns two turns on its center while revolving one turn around the center of the internal gear 175. Further, the number of the teeth of the gear 187 is chosen to be half of the number of the external teeth 175*b* of the internal gear 175. As schematically shown in FIG. 6, the distance between the axis of rotation of the carrier 181 and the axis of rotation of the planetary gear 179 is designated by r1, and the distance between the axis of rotation of the planetary gear 179 and the axis of rotation of the counter weight driving pin 183 is designated by r2.

Figure 7:
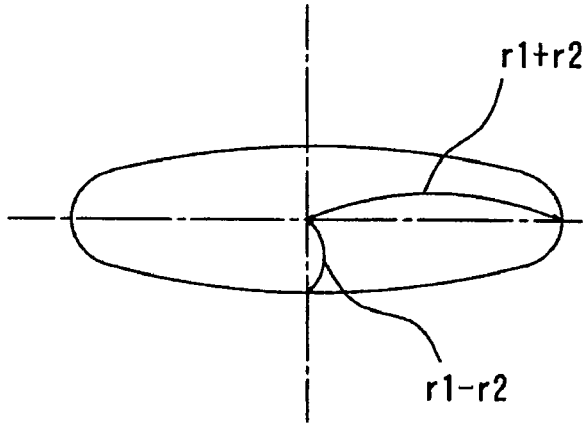
FIG. 7 is a schematic view illustrating a path of movement of a counter weight driving pin when a gear is locked in a certain position and a carrier is rotated.

When the gear 187 (and thus the internal gear 175) is locked in a certain position and the carrier 181 is rotated, as schematically shown in FIG. 7, the counter weight driving pin 183 moves along an elliptic path having a major axis of "2×(r1+r2)" and a minor axis of "2×(r1−r2)". When "r1−r2=0", the stroke of the counter weight driving pin 183 in the direction of the minor axis is zero. When the above locked position of the gear 187 is rotated 180°, the counter weight driving pin 183 moves along an elliptic path shown in FIG. 8, which path is obtained by rotating the path in FIG. 7 by 90°. Specifically, when the gear 187 is locked for every 180° rotation, the path of the counter weight driving pin 183 can be switched between the states shown in FIGS. 7 and 8. Therefore, if the counter weight 171 is mounted onto the counter weight driving pin 183, the linear stroke of the counter weight 171 can be switched between the longer stroke of "2×(r1+r2)" and the shorter stroke As shown in FIG. 3, when the planetary gear 179 is located in the rear end region (or the front end region) of the internal gear 175 in the axial direction of the hammer bit 113, the counter weight driving pin 183 is located in the nearest position to the point of proximity of the planetary gear 179 to the internal gear 175. Further, as shown in FIG. 4, when the planetary gear 179 is located in the rear end region (or the front end region) of the internal gear 175 in the axial direction of the hammer bit 113, the counter weight driving pin 183 is located in the remotest position from the point of proximity of the planetary gear 179 to the internal gear 175. In the state shown in FIG. 3, the second stopper 193 engages with the engagement part 188*a* of the cam 188 and locks the gear 187. In the state shown in FIG. 4, the first stopper 191 engages with the engagement part 188*a* of the cam 188 and locks the gear 187. Specifically, the phase difference between the rotation prevented positions in which the gear 187 is locked by the first and second stoppers 191, 193 is 180°. Thus, the internal gear 175 which has the external teeth 175*b* twice as many as the teeth of the gear 187 is prevented from rotating at the phase difference of 90° between its rotation prevented positions.

Operation and usage of the hammer 101 will now be explained. First, operation under loaded driving conditions wherein a load is applied on the hammer bit 113 by pressing the hammer bit 113 against the workpiece, will now be explained.

When the driving motor 121 is driven, the driver 163 is caused to reciprocate within the bore of the cylinder 165 via the output shaft 123, the speed change gear 141, the crank pin 147, the crank arm 159 and the connecting pin 161. As a result, the hammer bit 113 is driven linearly in its axial direction via the air cylinder mechanism 131 and the striking force transmitting mechanism 135. Specifically, when the driver 163 slides toward the hammer bit 113, the striker 134 is caused to reciprocate in the same direction within the cylinder 165 by the air spring action and collides with the impact bolt 136. The kinetic energy (striking force) of the striker 131 caused by the collision is transmitted to the hammer bit 113. Thus, the hammer bit 113 slidingly reciprocates within the tool holder 137 and performs a hammering operation on the workpiece.

During operation of the hammer 101, under loaded driving conditions, the slide sleeve 194 moves rightward as viewed in FIG. 1 against the biasing force of the slide sleeve biasing spring 196 by the reaction force against the hammer bit 113 pressing against the workpiece. At this time, the switching rod 195 is caused to move rightward as viewed in FIG. 1 and presses on the first stopper 191 from the backside so that the first stopper 191 is rotationally displaced around the support shaft 192 toward the cam 188 of the gear 187. When the first stopper 191 is thus rotationally displaced, the second stopper 193 is rotated via the first leaf spring 197 in the same direction as the first stopper 191. Thus, the claw 191*a* of the first stopper 191 disengages from the engagement part 188*a* of the cam 188. As a result, the gear 187 is allowed to rotate, so that the internal gear 175 is allowed to rotate.

FIG. 5 shows the manner of switching the internal gear 175 between the rotation prevented position and the rotation allowed position by means of the switching rod 195 under the loaded driving conditions. FIGS. 5(B) and 5(C) show the above-mentioned state in which the first and second stoppers 191, 193 are rotated by the switching rod 195 pressing on the first stopper 191 so that the internal gear 175 is allowed to rotate. FIG. 5 is a backside view of FIGS. 3 and 4. Thus, the direction of the pressing force of the switching rod 195 is shown opposite to that in FIGS. 3 and 4. The internal gear 175 is acted upon by the rotating force of the carrier 181 via friction with the internal gear 175 or via grease, or the rotating force caused when the planetary gear 179 revolves by friction between the planetary gear 179 and the carrier 181, or the rotating force caused by the reaction force from the counter weight 171 to be driven by the counter weight driving pin 183. Therefore, the instant when the gear 187 is allowed to rotate, the internal gear 175 rotates. When the internal gear 175 rotates 90° or the gear 187 rotates 180°, as shown in FIG. 5(D), the claw 193*a* of the second stopper 193 engages with the engagement part 188*a* of the cam 188, so that the internal gear 175 is prevented from rotating.

At this time, as shown in FIG. 3, when the planetary gear 179 is located in the rear end region (or the front end region) of the internal gear 175 in the axial direction of the hammer bit 113, the counter weight driving pin 183 is located in the nearest position to the point of proximity of the planetary gear 179 to the internal gear 175. In this state, when the counter weight driving pin 183 revolves while rotating, the counter weight driving pin 183 has a longer stroke in the longitudinal direction of the hammer 101 as schematically shown in FIG. 7. By utilizing the stroke of the counter weight driving pin 183, the counter weight 171 is driven in the axial direction of the hammer bit 113 and in a direction opposite to the reciprocating direction of the striker 134. In this manner, the counter weight 171 can efficiently reduce vibration during hammering operation of the hammer bit 113.

Next, operation under unloaded driving conditions wherein no load is applied to the hammer bit 113 will now be explained. Under unloaded driving conditions, no reaction force is generated against the hammer bit 113 from the workpiece. Therefore, the slide sleeve 194 moves leftward as viewed in FIG. 1 by the biasing force of the slide sleeve biasing spring 196. As a result, the pressing force of the switching rod 195 upon the first stopper 191 is eliminated. As shown in FIG. 5(D), in the state in which the switching rod 195 presses on the first stopper 191, the second leaf spring 199 is elastically deformed by the first stopper 191. Therefore, when the pressing force of the switching rod 195 is eliminated, the first stopper 191 is pushed back and the claw 191*a* is rotated in a direction of engagement with the engagement part 188*a* of the cam 188. At the same time, the second stopper 193 is pushed by the first stopper 191 and rotated away from the cam 188. Thus, the claw 193*a* of the second stopper 193 disengages from the engagement part 188*a* of the cam 188. As a result, the gear 187 is allowed to rotate, so that the internal gear 175 is allowed to rotate.

Then, the instant when the gear 187 is allowed to rotate, the internal gear 175 rotates because the internal gear 175 is acted upon by the rotating force of the carrier 181 via friction with the internal gear 175 or via grease, or the rotating force caused when the planetary gear 179 revolves by friction between the planetary gear 179 and the carrier 181, or the rotating force caused by the reaction force from the counter weight 171 to be driven by the counter weight driving pin 183. In this embodiment, when the internal gear 175 rotates 90°, the claw 191*a* of the first stopper 191 engages with the engagement part 188*a* of the cam 188, so that the internal gear 175 is prevented from rotation.

Figure 8:
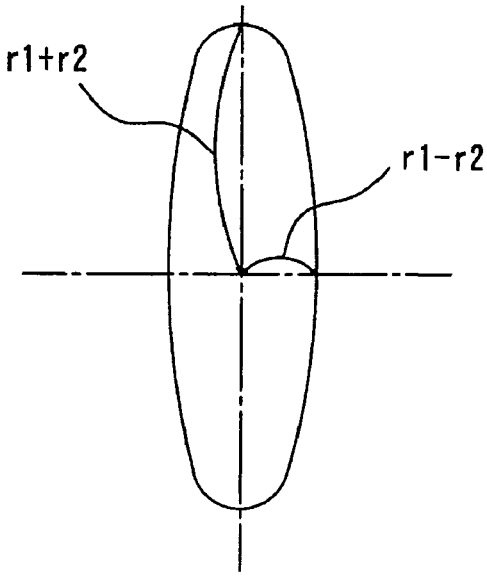
FIG. 8 is a schematic view illustrating a path of movement of the counter weight driving pin when the gear is locked in a certain position and the carrier is rotated.

At this time, as shown in FIG. 4, when the planetary gear 179 is located in the rear end region (or the front end region) of the internal gear 175 in the axial direction of the hammer bit 113, the counter weight driving pin 183 is located in the remotest position from the point of proximity of the planetary gear 179 to the internal gear 175. In this state, when the counter weight driving pin 183 revolves while rotating, the counter weight driving pin 183 has a shorter stroke in the longitudinal direction of the hammer 101 as schematically shown in FIG. 8. In this case, when "r1−r2=0" in FIG. 8, the apparent stroke of the counter weight driving pin 183 located in the remotest position from the point of proximity of the planetary gear 179 to the internal gear 175 is zero in the longitudinal direction of the hammer 101 even though the planetary gear 179 revolves.

As a result, under unloaded driving conditions, even if the planetary gear 179 revolves around the center of rotation of the internal gear 175, the counter weight driving pin 183 does not move in the longitudinal direction of the hammer 101. In other words, under unloaded driving conditions, even though the driving motor 121 is driven and the planetary gear 179 revolves around the center of rotation of the internal gear 175, the counter weight driving pin 183 does not drive the counter weight 171 in the longitudinal direction of the hammer 101.

The internal gear 175 is allowed to rotate according to the load applied to the hammer 113. The relative position of the counter weight driving pin 183 changes with respect to the point of proximity of the planetary gear 179 to the internal gear 175. Thus, the linear stroke of the counter weight 171 can be changed, so that vibration can be efficiently reduced during hammering operation of the hammer bit 113 in the hammer 101.

According to the representative embodiment, the gear 187 can rotate only in one direction via the one-way clutch 189. Therefore, the gear 187 and the internal gear 175 can be reliably locked without rattling in both directions simply by engagement of the claw 191*a* of the first stopper 191 or the claw 193*a* of the second stopper 193 with the engagement part 188*a* of the cam 188, or simply by preventing rotation only in the direction in which rotation is allowed. For example, in a construction in which an internal gear is allowed to rotate in both directions, rattling may be caused unless the internal gear is prevented from rotation with respect to each direction when the internal gear is locked. According to this embodiment, as mentioned above, the internal gear 175 can be reliably locked in a predetermined position. Thus, the accuracy of the locked position can be enhanced and stable operation can be realized.

Further, rotation of the internal gear 175 is prevented by locking the gear 187 which engages with the external teeth 175*b* of the internal gear 175. Specifically, with the construction in which the cam gear 187 that is smaller than the internal gear 175 is locked, compared, for example, with the construction in which the internal gear 175 is directly locked, the rotation preventing mechanism 185 of the internal gear 175 can be made more compact and can obtain the freedom of layout.

Further, the planetary gear 179 engages with the internal gear 175 via the idle gears 177. With this construction, freedom can be obtained in choosing the center of revolution (the center of rotation) of the planetary gear 179 with respect to the internal gear 175, as well as in choosing the location of the counter weight driving pin 183. For example, when the planetary gear 179 directly engages with the internal gear 175, the center of revolution (the center of rotation) of the planetary gear 179 with respect to the internal gear 175 is limited to one point. To the contrary, in the representative embodiment, the planetary gear 179 engages with the internal gear 175 via the idle gears 177 and therefore, the center of revolution of the planetary gear 179 with respect to the internal gear 175 is not limited to one point. Thus, the motion components of the counter weight driving pin 183 in the axial direction of the tool bit can be arbitrarily provided.

Further, because the planetary gear 179 engages with the internal gear 175 via the idle gears 177, the location of the counter weight driving pin 183 with respect to the planetary gear 179 can be arbitrarily chosen.

Second Representative Embodiment

According to the embodiment, the stroke of the counter weight 171 is provided as being changeable. However, the present invention can also be applied to a construction in which the stroke of a driving mechanism for driving the hammer bit 113 can be changed. Specifically, in such a construction, the stroke of the crank arm 159 can be changed between under the loaded driving conditions and under the unloaded driving conditions. To this end, a crank arm driving mechanism may be provided which is equivalent to the counter weight driving mechanism 173 including the internal gear 175, the planetary gear 179 and the counter weight driving pin 183, which counter weight driving mechanism 173 has been described with reference to FIGS. 2 to 8 in the above-mentioned embodiment. The crank arm driving mechanism may be disposed in the crank mechanism 131 between the crank arm 159 and the speed change gear 141 rotated by the rotating output of the driving motor 121 to drive the crank arm 159. Further, a rotation preventing mechanism may be provided which is equivalent to the rotation preventing mechanism 185 including the gear 187, the one-way clutch 189, the first and second stoppers 191, 193 and the switching rod 195 in the above-mentioned embodiment. The rotation preventing mechanism can change the rotation prevented position of the internal gear 175 in the crank arm driving mechanism.

With this construction, the internal gear 175 is allowed to rotate by a predetermined degree according to a load applied to the hammer bit 113. Thus, the relative position of the crank pin 147 can be changed with respect to the point of proximity between the internal gear 175 and the planetary gear 179. As a result, the linear stroke of the crank arm 159 and thus the linear stroke of the driver 163 can be changed.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

DESCRIPTION OF NUMERALS

101 hammer
103 body
105 motor housing
107 gear housing
108 housing cap
109 hammer bit mounting chuck
111 handgrip
113 hammer bit (tool bit)
121 driving motor
123 output shaft
125 output shaft gear part
131 crank mechanism
133 air cylinder mechanism
134 striker
135 striking force transmitting mechanism
136 impact bolt
137 tool holder
138 cushion
141 speed change gear
143 gear shaft
145 gear shaft support bearing
147 crank pin
147*a* top pin part
159 crank arm
161 connecting pin
163 driver
165 cylinder
171 counter weight
171*a* slot
171*b* guide slot
172 guide pin
173 counter weight driving mechanism (power transmitting mechanism)
175 internal gear
175*a* internal teeth
175*b* external teeth
177 idle gear
177*a* shaft
179 planetary gear
179*a* shaft
181 carrier
181*a* engagement recess
182 carrier support bearing
183 counter weight driving pin (power transmitting part)
185 rotation preventing mechanism (power transmitting mechanism)
186 idle gear
187 gear with cam

188 cam
188*a* engagement part
189 one-way clutch
191 first stopper
191*a* claw
192 support shaft
193 second stopper
193*a* claw
194 slide sleeve
195 switching rod
196 slide sleeve biasing spring
197 first leaf spring
199 second leaf spring

I claim:

1. A reciprocating power tool comprising:

a tool bit that performs a predetermined operation on a workpiece by reciprocating, a driving motor that drives the tool bit and a power transmitting mechanism that converts a rotating output of the driving motor into linear motion in the axial direction of the tool bit, the power transmitting mechanism comprising:

an internal gear rotatably supported to receive the rotating output of the driving motor all the time, a planetary gear driven by the rotating output of the driving motor to revolve around the center of the internal gear, a power transmitting part eccentrically disposed on the planetary gear, a rotation preventing mechanism that normally prevents rotation of the internal gear, the rotation preventing mechanism being adapted to allow rotation of the internal gear in relation to a load applied to the tool bit and to allow the internal gear to rotate by a predetermined degree and in a predetermined direction, whereby the relative position of the power transmitting part is changed with respect to a point of proximity of the planetary gear to the internal gear, so that a linear stroke of the power transmitting part in the axial direction of the tool bit is changed and an internal gear rotation lock that prevents the internal gear from rotating in a direction opposite to said predetermined direction.

2. The reciprocating power tool as defined in claim 1, wherein the tool bit includes a hammer bit that performs a hammering operation on the workpiece by receiving a striking force of a striker, the reciprocating power tool further includes a counter weight that reciprocates in the axial direction of the hammer bit by the rotating output of the driving motor and serves to reduce vibration and the power transmitting part is utilized to drive the counter weight.

3. The reciprocating power tool as defined in claim 1, further comprising a striker that reciprocates in the axial direction of the tool bit, wherein the tool bit comprises a hammer bit that performs a hammering operation on the workpiece by receiving a striking force of the striker, and wherein the power transmitting part is connected to a crank arm that serves to drive the striker linearly in the axial direction of the hammer bit.

4. The reciprocating power tool as defined in claim 1, wherein the internal gear has external teeth on its outer peripheral surface, and wherein the rotation preventing mechanism prevents rotation of the internal gear by locking a gear that engages with the external teeth of the internal gear, while the rotation preventing mechanism allows rotation of the internal gear by releasing the lock of the gear.

5. The reciprocating power tool as defined in claim 1, wherein the internal gear rotation lock is defined by a one-way clutch.

6. The reciprocating power tool as defined in claim 1, wherein the planetary gear engages with the internal gear via at least one idle gear.

7. The reciprocating power tool as defined in claim 1, wherein the internal gear is allowed to rotate in relation to a load applied to the tool bit, whereby, when the point of proximity of the planetary gear to the internal gear is located in a front end region or a rear end region of the internal gear in the axial direction of the tool bit, the power transmitting part is located at or near the point of proximity.

8. The reciprocating power tool as defined in claim 1, wherein the internal gear is allowed to rotate in relation to a load applied to the tool bit, whereby, when the point of proximity of the planetary gear to the internal gear is located in a front end region or a rear end region of the internal gear in the axial direction of the tool bit, the power transmitting part is located in an edge region of the planetary gear which faces said point of proximity.

9. The reciprocating power tool as defined in claim 1, wherein the internal gear is allowed to rotate according to a load applied to the tool bit, whereby, when the point of proximity of the planetary gear to the internal gear is located in a front end region or a rear end region of the internal gear in the axial direction of the tool bit, the power transmitting part is located at or near the point of proximity, and wherein the planetary gear turns two turns on its center while revolving one turn around the center of the internal gear.

10. A reciprocating power tool comprising:

a tool bit for performing a predetermined operation on a workpiece by reciprocating, a driving motor that drives the tool bit and a power transmitting mechanism that converts a rotating output of the driving motor into linear motion in the axial direction of the tool bit, the power transmitting mechanism comprising:

an internal gear having external teeth on its outer peripheral surface, the internal gear being rotatably supported and adapted to receive the rotating output of the driving motor all the time, a planetary gear that is driven by the rotating output of the driving motor and revolves around the center of the internal gear, a power transmitting part eccentrically disposed on the planetary gear, a rotation preventing mechanism that normally prevents rotation of the internal gear by locking a gear that engages with the external teeth of the internal gear, the rotation preventing mechanism being adapted to allow rotation of the internal gear in relation to a load applied to the tool bit and to allow the internal gear to rotate by a predetermined degree and in a predetermined direction, whereby the relative position of the power transmitting part is changed with respect to a point of proximity of the planetary gear to the internal gear, so that a linear stroke of the power transmitting part in the axial direction of the tool bit is changed and an internal gear rotation lock that prevents the internal gear from rotating in a direction opposite to said predetermined direction.

11. A reciprocating power tool comprising:

a tool bit that performs a predetermined operation on a workpiece by reciprocating, a driving motor that drives the tool bit and a power transmitting mechanism that converts a rotating output of the driving motor into linear motion in the axial direction of the tool bit, the power transmitting mechanism comprising:

an internal gear having external teeth on its outer peripheral surface, the internal gear being rotatably supported and adapted to receive the rotating output of the driving motor all the time, a planetary gear that is driven by the rotating output of the driving motor and revolves around the center of the internal gear, a power transmitting part that is eccentrically disposed on the planetary gear, a rotation preventing mechanism that normally prevents rotation of the internal gear by locking a gear that engages with the external teeth of the internal gear, the rotation preventing mechanism being adapted to allow rotation of the internal gear according to a load applied to the tool bit and to allow the internal gear to rotate by a predetermined degree and in a predetermined direction, whereby the relative position of the power transmitting part is changed with respect to a point of proximity of the planetary gear to the internal gear, so that a linear stroke of the power transmitting part in the axial direction of the tool bit is changed and a one-way clutch that prevents the internal gear from rotating in a direction opposite to said predetermined direction.

* * * * *